United States Patent [19]

Taggart

[11] Patent Number: 4,899,459

[45] Date of Patent: Feb. 13, 1990

[54] SIDING APPLICATION TOOL

[76] Inventor: Andrew W. Taggart, 15425 6th SW., Seattle, Wash. 98166

[21] Appl. No.: 294,795

[22] Filed: Jan. 9, 1989

Related U.S. Application Data

[63] Continuation-in-part of Ser. No. 250,862, Sep. 29, 1988, abandoned, which is a continuation-in-part of Ser. No. 102,630, Sep. 30, 1987, abandoned.

[51] Int. Cl.[4] ..... G01B 3/30

[52] U.S. Cl. ..... 33/646

[58] Field of Search ..... 33/646, 647, 648, 649

[56] References Cited

U.S. PATENT DOCUMENTS

| | | |
|---|---|---|
| 386,329 | 7/1888 | Luce et al. . |
| 1,890,928 | 12/1932 | Black . |
| 2,762,130 | 9/1956 | Olson . |
| 3,440,777 | 4/1969 | Martin . |
| 3,463,480 | 8/1969 | Edstrom . |
| 3,490,152 | 1/1970 | Printz . |
| 3,518,770 | 7/1970 | Cromleigh . |
| 3,904,184 | 9/1975 | Krueger . |
| 4,089,141 | 5/1978 | Heroux . |
| 4,155,175 | 5/1979 | Stiles . |
| 4,159,029 | 6/1979 | Matthews . |
| 4,164,346 | 8/1979 | Sickler . |
| 4,208,799 | 6/1980 | Frantello . |
| 4,425,714 | 1/1984 | Kelly . |
| 4,658,490 | 4/1987 | Czelusniak . |
| 4,698,942 | 10/1987 | Swartz . |

*Primary Examiner*—Harry N. Haroian

*Attorney, Agent, or Firm*—Keith D. Gehr

[57] ABSTRACT

A disposable tool for assisting in applying horizontal and diagonal siding. This comprises a strap having a plurality of attached and regularly spaced apart hangers. The hangers are spaced to provide for the desired overlap of siding as well as the correct distance between the bottom edges of siding pieces. In one version of the tool it is mounted so that it positions and holds the lower edge of a siding strip prior to nailing. The hanger portions are removeable after the siding strips have been positioned and secured to a wall. In another version the tool is mounted so that it positions and locates the upper edge of a siding strip. In this case it remains in place and is covered as successively higher strips of siding are applied.

17 Claims, 3 Drawing Sheets

SIDING APPLICATION TOOL

This application is a continuation-in-part of application Ser. No. 250,862, filed Sept. 29, 1988, now abandoned which was a continuation-in-part of Ser. No. 102,630, filed Sept. 30, 1987, now abandoned.

BACKGROUND OF THE INVENTION

This invention relates to tools to assist in the application of siding to a wall or similar structure. The tools facilitate the fast and accurate placement of siding on a wall.

Heretofore, no really accurate and fast tool for siding application has been developed. Siders still employ about the same methods and tools that have been used for the past two hundred years. They measure each piece of siding for the desired overlap with a ruler, combination square or some other hand held gauge. Extensive use of a level is required, sometimes on every piece of siding. All of this measuring, gauging and leveling is slow and produces many errors. These errors are compounded if a gauge slips or a level is not accurate. Two siders are generally required on longer pieces of siding. This greatly increases the chance of errors, as well as being a considerable waste of manpower. On large buildings, such as apartments, several teams of siders work at various places around the building at the same time using different gauges and methods of placing the siding. Small wonder then that variations in spacing and leveling occur around the building.

Several attempts to overcome these problems have been made but success has been limited. Martin, in U.S. Pat. No. 3,440,777, discloses a shake strip assembly which is mounted to the wall to accommodate a row of shakes. This is subsequently removed and raised for the next course. Cromleigh discloses, in U.S. Pat. No. 3,518,770, a tool for placing the initial piece of siding on a building. Edstrom discloses, in U.S. Pat. No. 3,463,480, angle irons with adjustable dogs which are used at corners to gauge siding. Krueger discloses, in U.S. Pat. No. 3,904,184, a pair of hangers nailed to the wall. Siding is slipped behind the hangers and held to the wall. After the siding is nailed, the hangers are relocated and the process repeated for successive pieces. Other patents, including U.S. Pat. Nos. 3,490,152; 4,159,029; 4,089,141; 4,155,175; 4,164,346; 4,425,714; and 4,658,490, represent variations on the same basic concept. In each case, after one piece of siding is located, a pair of hangers is positioned either by measuring and nailing or by clamping to the initial board or hanging on the initial board. A piece of siding is then placed on the hangers and secured to the wall after which the tools are removed and the process repeated. Each of these tools relies on the preceding piece of siding for its location and relocation. Variations in width of siding, along with warping and twisting of siding pieces results in errors. Constant relocation, anchoring and releasing of the tools extends job time without appreciably increasing accuracy.

SUMMARY OF THE INVENTION

The present invention is found in two general versions and is a disposable tool or gauge for use in assisting a person mounting siding strips on a wall or similar surface. In a first version the tool is used to locate and support the lower edge of a strip of siding. The supporting portion of the tool is then removed after the siding strips are nailed. The second version is used to locate, and in some embodiments to support, the upper edge of a siding strip. This version remains in place after the siding is permanently installed.

Both versions have a thin, elongated flexible strap-like piece which is mounted or suspended on the wall prior to application of horizontal or diagonal siding strips. Two or more of the tools are normally used in spaced apart relationship. In both versions the strap has attached to it a plurality of uniformly spaced apart, generally L-shaped indexing means. A proximal leg of the indexing means is attached to and is generally normal to the strap and protrudes therefrom. The proximal portion terminates in a hook-like distal portion. The indexing means on the straps serve to position, and in some embodiments to hold, siding strips prior to their being nailed to the wall.

In the first version the strap portion of the tool is nailed or otherwise attached to the wall with the distal portions of the indexing means oriented upward. These indexing means act as hangers or retainers for the siding strips. They are preferably attached to the strap so that, after the siding is permanently applied, they may be readily pulled off of the strap and out from under the strips of siding. Alternatively, the entire assembly may be made very flexible so that both strap and hangers may be pulled upward and removed from behind the applied siding strips.

In the second version, the strap is permanently attached to the wall with the distal portions of the indexing means oriented downward. Here the upper edges of the siding strips are hand held, or in preferred embodiments retained, against the indexing portions while being nailed. One preferred embodiment employs a tang protruding from the strap just below the indexing means. This tang is shorter in length than the proximal portion of the indexing means and serves to hold the siding strip in place while it is being nailed. Each indexing means is then covered as the next higher course of siding is put in place.

It is an object of the present invention to provide a tool which will easily, reliably and with great accuracy, assist in uniformly applying siding in either a horizontal or diagonal manner.

It is another object to provide a tool which significantly reduces siding time and errors in applying siding.

It is a further object to provide a tool which requires a minimum of training or skill to use.

It is also an object to provide a tool which eliminates the need for measuring and marking siding pieces for overlap.

It is yet another object to provide a tool which eliminates the need for using a level after the tool's initial placement.

It is still a further object to provide a tool which facilitates the marking and cutting of siding around any shape door, window, vent or other aperture in a wall.

It is also another object to provide a tool which eliminates the need for two siders when placing long pieces of siding.

Readers will find further objects and advantages of the invention from a consideration of the following detailed description and accompanying drawings.

BRIEF DESCRIPTION OF THE INVENTION

Figure 1:
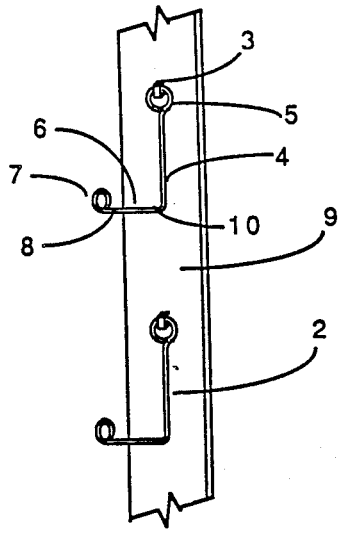
FIG. 1 shows a perspective front elevation view of a siding application tool made according to the first version of the invention.
Figure 2:
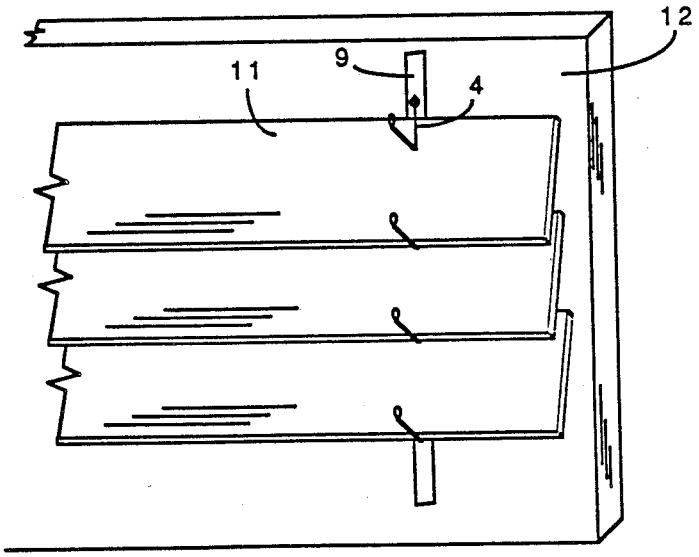
FIG. 2 shows a perspective front elevation view of such a tool holding typical siding pieces.

FIG. 1 shows the siding tool according to one embodiment of the first version of the invention. The tool comprises a vertical strap of material 9 which is preferably made of polyester strap. A plurality of L-shaped hangers 2, preferably made of spring wire, are located at regular intervals along the strap by means of an attachment 3. The length of the intervals depends on the width of the siding 11 to be used and is best shown by FIG. 2. The means of attachment comprises a staple strong enough to support siding pieces, but which can be pulled free from the strap with a claw hammer or other tool. Other separable means of attachment, such as a relatively low strength adhesive, are equally suitable. The hangers are comprised of a vertical leg 4, which bends at substantially a right angle 10 from the strap 9 to form a protruding horizontal leg 6.

FIG. 2 shows that the vertical leg 4 is greater in length than the anticipated amount of overlap of the siding pieces 11 to be used, generally about two inches, and terminates at its uppermost end in approximately a one-fourth inch loop 5. The horizontal leg 6, in the preferred embodiment, is wide enough to accommodate two thicknesses of siding and terminates in a hook-like loop 7.approximately one-fourth inch in diameter which is bent up at substantially a right angle 8 to the horizontal leg. Prior to mounting the strap on wall 12, the strap and hangers could be in a compact roll.

Figure 3:
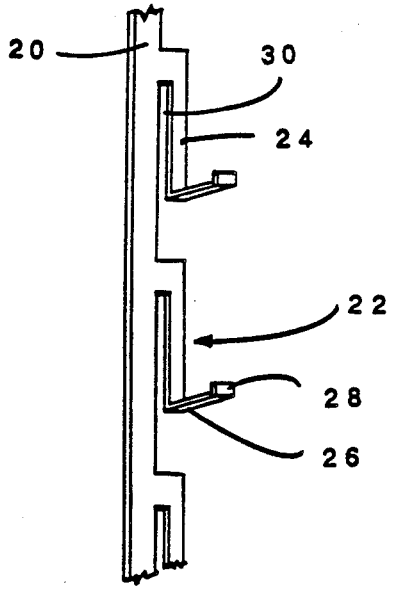
FIG. 3 is a perspective front elevation view of an alternative construction of the first version of the siding application tool.
Figure 4:
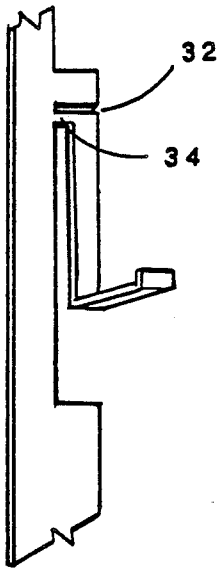
FIG. 4 shows a variation of the tool of FIG. 3.
Figure 5:
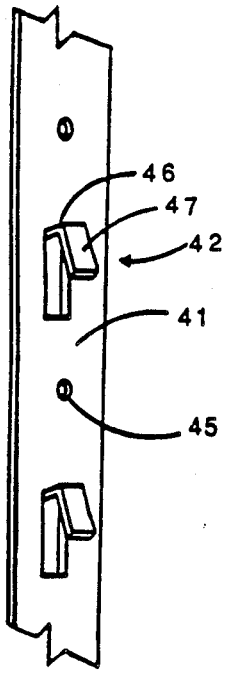
FIG. 5 shows the simplest embodiment of a second version of the tool.

An alternate embodiment of the siding tool is shown in FIGS. 3 and 4. A vertical strap of material 20 is punched or otherwise formed to form a series of L-shaped hangers, generally indicated at 22, and a saddle-shaped cut out slot 30. The material cut from slot 30 is removed. As in the earlier embodiments, hanger 22 has a longer portion 24 and a shorter portion 26, the latter being bent so as to be generally normal to and protruding from strap 20. The short portion 26 of the hanger may be terminated with a turned up portion 28 to form a hook or stop for retaining strips of siding. The combined length of hanger portions 24, 26, and 28 will generally be equal to, and will not exceed, the length of slot 30. Slot 30 provides a convenient means of attachment of the tool to a wall. A nail or other suspension means can be conveniently located at an appropriate position on the wall. The tool is supplied in an appropriate length and slot 30 is simply hung over the head of the nail for later easy removal if desired.

Strap 20 is conveniently made from light sheet metal, such as 22 gauge galvanized steel, although certain plastic materials will also be equally suitable.

After the siding strips have been nailed to the wall the upper end of the tool may be grasped by pilers and pulled upward to remove it. The hanger portions 26 and 28 are sufficiently flexible to bend to a generally straightened conformation and slip behind the siding strips. Of course, after portions 26 and 28 are out of visual sight the tool may also be left in place without any adverse appearance effects.

FIG. 4 shows an alternative construction of the FIG. 3 tool just described. A transverse slot 32 may be cut in strap 20 so that the hanger is left attached by only a thin neck 34. This forms a frangible attachment zone similar functionally to the attachment of hangers 2 to strap 9, as shown in FIG. 1. When the tool is made from 22 gauge sheet steel a width of 0.060 inches for neck 34 has been found to be very satisfactory. Using this construction, hanger 22 can be removed by a downward pull of pliers with strap 20 being left in place.

The operation of the first version of the siding application tool for use with horizontal siding will now be described. The user first selects a point at the bottom of the wall where the siding is to start. The strap is mailed or otherwise attached to the wall with the lowest hanger in a position to accept the first piece of siding. The strap is unrolled up the wall and nailed again at a point as high as the user can easily reach. Any extra portion of the roll of strap is also secured at this point. A second strap is similarly attached to the wall at an appropriate distance along the wall from the first strap. Care must be taken to ensure that the hangers on the two straps are level with each other. No additional leveling will be necessary. Several side-by-side straps may be needed for longer walls. A piece of siding is then placed on the horizontal legs of the bottom set of hangers and under the second set of hangers. The user repeats this process as he works up the wall. After the siding has been secured to the wall the hangers are removed as has been described earlier. Scaffolding can be placed and the rolls of strap extended up the wall where the process is repeated. At the top of the wall, excess strap is cut off for use at a new location.

Virtually the same approach is used for diagonal siding as for horizontal siding. The major differences lie in the location of the straps. Opposing pairs of hangers must be set at the correct diagonal position instead of at a level position. Additional nails through the strap will prevent its being pushed out of line as the diagonal siding is applied.

The tool also facilitates fitting pieces to wall openings. By using hangers with horizontal legs longer than two thicknesses of siding, it is possible to set a second siding piece directly covering the preceding piece below the opening to be fitted. The user then has both hands free to scribe lines or measure to the opening for the desired cuts. Scribing distance will be exactly the same as the measurement between consecutive hangers on the strap. The same procedure is used above the opening to scribe cuts in the lower part of siding pieces.

Figure 6:
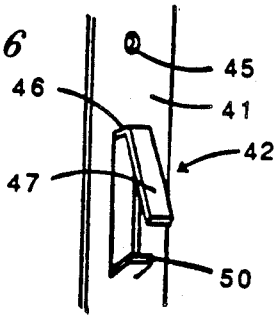
FIG. 6 is a preferred embodiment of the tool of FIG. 5.
Figure 7:
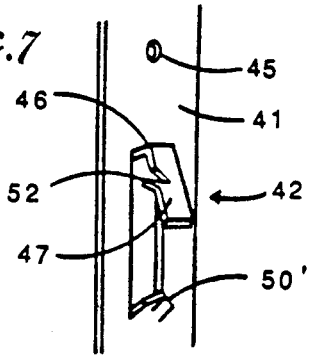
FIG. 7 is a further variation in the tool of FIG. 5.

The second version of the siding application tool is shown in FIGS. 5–8. It comprises a thin flexible strap 41 made of similar or identical material to the straps of the first version. This may have nailing holes 45 for permanently attaching it to the wall. It further has a spaced apart plurality of siding indexing means 42. These comprise a proximal portion 46, permanently attached to and generally normal to the strap 41, and a hook-like turned down distal portion 47. A preferred version, as shown in FIG. 6, also has a protruding tang 50 located immediately below indexing means 42. This serves as a fulcrum point to hold a siding strip that has been inserted against distal portion 46. The turned down distal portion 47 serves as a retainer in this case and after inserting the siding strip it is not necessary for the sider to hold it against the indexing portion while it is being nailed. To increase the holding power, the distal portion 47 may have an inturned spur or tooth 52 which is angled back toward the strap (FIG. 7). This figure also shows a preferred version 50' of the tang which is formed to a relatively sharp point and has been crimped into a gable shape for greater strength.

Figure 8:
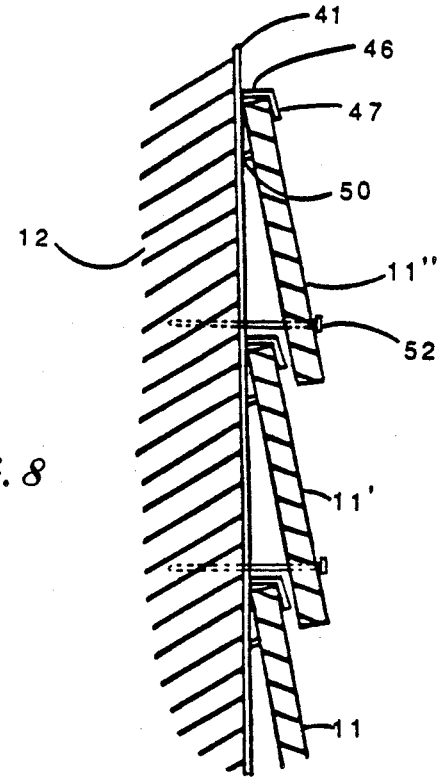
FIG. 8 shows the tool of FIGS. 5–7 as used to assist in the installation of siding.

FIG. 8 shows how the second version of the tool is employed. Spaced apart tools will be located on the wall to be sided and leveled as described before. A first course of siding 11 is then inserted against the protruding proximal portion of the indexing means where it is held in place by tang 50. The siding strips are then attached using a sufficient number of nails 52. The second and third siding courses 11' and 11'' are applied sequentially, each covering the indexing means of the course immediately below.

While the above description contains specific examples, the reader should not construe these as limitations on the scope of the invention, but merely as exemplifications of the preferred embodiments thereof. Those skilled in the art will envision that many other possible variations are within the scope of the invention. They will be able to change the shape of the hangers or make them from a variety of materials. As one example, attachment of the hangers to the strap of the first version could be by thread, glue, clinching, or crimping, among other means. By using a clip arrangement along the strap, it is possible to disengage the hangers by pulling down on the bottom end of the strap which can then be pulled down and out from behind the siding. The hangers can also be recovered and the entire tool re-used. The entire tool could be formed as a one-piece tool. Accordingly, the reader is requested to determine the scope of the invention by the appended claims and their legal equivalents and not solely by the examples which have been given.

I claim:

1. A tool or gauge for mounting sliding strips on a wall or similar surface which comprises:

a thin, elongated flexible strap-like means for attachment to a wall prior to application of siding strips;

a plurality of uniformly spaced apart, generally L-shaped hanger means, each hanger means having a proximal portion separably attached to the strap means and a distal portion positioned generally normal to the strap means and protruding therefrom; and attachment means for removably fastening the hanger means to the strap means, so that when the tool is mounted on a wall the hanger means serve to hold and position siding strips prior to their attachment to the wall and said hanger means can be pulled free of the strap means and withdrawn from beneath siding strips after said siding strips have been attached.

2. The tool of claim 1 in which the attachment means is a staple.

3. The tool of claim 1 in which the attachment means is a low strength adhesive.

4. The tool of claim 1 in which the hanger means is formed integrally with the strap means and the attachment means is a frangible zone between the hanger means and strap means.

5. The tool of claim 4 in which the tool is formed of thin sheet metal having sufficient flexibility to be pulled from behind siding strips after said siding has been attached.

6. The tool of claim 1 in which the protruding portion of the hanger means has a terminal short turned up hook-like portion to help retain siding strips.

7. The tool of claim 5 in which the protruding portion of the hanger means has a terminal short turned up hook-like portion to help retain siding strips.

8. The tool of claim 4 which further has a saddle-shaped suspension slot means at the junction of the proximal end of the hanger means with the strap means, said slot means enabling the tool to be hung from a nail or similar retaining device.

9. A tool or gauge for use in mounting siding strips on a wall or similar surface which comprises:

a thin elongated flexible strap-like means for attachment to a wall prior to application of siding strips;

a plurality of uniformly spaced apart, generally L-shaped index means having a proximal portion permanently attached generally normal to and protruding form the strap means, and a hook-like turned down distal portion; and a short rigid tang means attached to at least one of the strap means or turned down distal portion of the index means for holdably engaging a siding strip, so that when a tool is mounted on a wall the upper edge of a siding strip may be placed against the index means to quickly position the strip and the tang means will hold the strip in place prior to attachment to the wall.

10. The tool of claim 9 in which the rigid tang means is positioned generally normal to said strap-like means below the index means.

11. The tool of claim 9 in which the tang means comprises a tooth-like means which extends from the turned down distal portion of the index means back toward the strap means.

12. The tool of claim 10 which further includes a tooth-like tang means which extends from the turned down distal portion of the index means back toward the strap-like means, said tooth-like tang means serving with said other tang means to hold a siding strip in place against the index means.

13. The tool of claim 10 in which the tang means is pointed.

14. The tool of claim 12 in which the tang means is pointed.

15. The tool of claim 10 in which the tang is crimped into a gable shape for additional rigidity.

16. The tool of claim 9 in which the strap-like means additionally has a plurality of spaced apart nailing apertures.

17. The tool of claim 10 in which the tang means is shorter in length than the proximal portion of the index means.

* * * * *